US011225929B2

(12) United States Patent
Takagawa et al.

(10) Patent No.: US 11,225,929 B2
(45) Date of Patent: Jan. 18, 2022

(54) INTERNAL COMBUSTION ENGINE

(71) Applicant: TOYOTA JIDOSHA KABUSHIKI KAISHA, Aichi-ken (JP)

(72) Inventors: Hajime Takagawa, Susono (JP); Yoshiki Endo, Toyota (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/128,202

(22) Filed: Dec. 21, 2020

(65) Prior Publication Data

US 2021/0222644 A1 Jul. 22, 2021

(30) Foreign Application Priority Data

Jan. 20, 2020 (JP) ..... JP2020-006910

(51) Int. Cl.

| | |
|---|---|
| ***F02F 1/36*** | (2006.01) |
| ***F01L 1/047*** | (2006.01) |
| ***F01M 11/00*** | (2006.01) |
| ***F01M 11/02*** | (2006.01) |
| ***F01L 1/02*** | (2006.01) |
| *B22D 25/02* | (2006.01) |
| *F01M 1/02* | (2006.01) |

(52) U.S. Cl.

CPC ..... *F02F 1/36* (2013.01); *F01L 1/022* (2013.01); *F01L 1/047* (2013.01); *F01M 11/0004* (2013.01); *F01M 11/02* (2013.01); *B22D 25/02* (2013.01); *F01M 1/02* (2013.01)

(58) Field of Classification Search

CPC ... F02F 1/36; F01L 1/022; F01L 1/047; F01L 1/024; F01L 2001/054; F01M 11/0004; F01M 11/02; F01M 2011/0033; F01M 2011/0045; F01M 2011/0066; F01M 2011/023

See application file for complete search history.

(56) References Cited

U.S. PATENT DOCUMENTS

2001/0055924 A1* 12/2001 Nanami ..... F01N 13/004 440/89 F
2007/0062478 A1* 3/2007 Netsu ..... F01M 11/064 123/193.5
2008/0092843 A1* 4/2008 Yamada ..... F02F 1/40 123/193.5
2011/0079187 A1* 4/2011 Steiner ..... F01M 9/102 123/41.82 R
2018/0223707 A1* 8/2018 Demeulenaere ... F01M 11/0004

FOREIGN PATENT DOCUMENTS

JP 201319313 A 1/2013

* cited by examiner

*Primary Examiner* — Syed O Hasan
(74) *Attorney, Agent, or Firm* — Hauptman Ham, LLP

(57) ABSTRACT

Intake and exhaust cam shafts are disposed a cylinder head in a vertical direction. The cylinder head comprises a first through hole and a second through hole. The first through hole penetrates an upper surface deck from a deck surface towards a lower surface of the cylinder head. The deck surface is a surface constituting an upper surface deck of the cylinder head. The second through hole opens to a side surface of the cylinder head in which cam pulleys of intake and exhaust cam shafts are provided. The second through hole penetrates the upper surface deck along an axial direction of the intake and exhaust cam shafts. The second through hole is positioned vertically below an opening in the deck surface of the first through hole.

9 Claims, 7 Drawing Sheets

INTERNAL COMBUSTION ENGINE

CROSS-REFERENCE TO RELATED APPLICATION

The present application claims priority under 35 U.S.C. § 119 to Japanese Patent Application No. 2020-006910, filed Jan. 20, 2020. The contents of this application are incorporated herein by reference in their entirety.

TECHNICAL FIELD

Present disclosure relates to an internal combustion engine (hereinafter also referred to as an "engine").

BACKGROUND

Examples of main members of the engine mounted on a vehicle include a cylinder head, a cylinder block, a crankcase, and an oil pan. The cylinder head includes an intake port and an exhaust port. A piston is accommodated in the cylinder block. A crankshaft is accommodated in the crankcase. An engine oil is stored in the oil pan.

The engine includes an oil pump driven in conjunction with a rotation of a crankshaft. The oil pump draws up the engine oil in the oil pan and supplies it to a delivery gallery in the engine. The engine oil supplied to the delivery gallery is supplied to relevant components of the engine, such as a sliding portion and a bearing portion. The engine oil supplied to the relevant components facilitate movement of the relevant components and cool the relevant components. The engine oil is then collected in the oil pan via a return path in the engine.

When the engine oil receives heat from the relevant components, temperature of the oil rises. In order to maintain lubricating function of the engine oil, it is necessary to lower the oil temperature below a certain temperature. Examples of cooling methods include a forced cooling by an external device such as an oil cooler. As a prior art using the oil cooler, a cooling device of the engine disclosed in JP2013-019313A is exemplified.

SUMMARY

However, using an oil cooler has the problem of complicating the circulation of engine oil and the cooling system. There is also a problem that an addition of an external devices leads to an increase in cost.

It is an object of the present disclosure to provide a novel engine capable of cooling the engine oil without resorting to the cooling by the external device such as the oil cooler.

A first aspect of the present disclosure is an engine for solving the problem mentioned above, and has the following features.

The engine comprising a cylinder head and intake and exhaust cam shafts.

The cylinder head comprises a water jacket.

The intake and exhaust cam shafts are disposed above the cylinder head in a vertical direction. The intake and exhaust cam shafts are supplied with an engine oil in an oil pan.

The cylinder head comprises a first through hole and a second through hole.

The first through hole penetrates an upper surface deck from a deck surface towards a lower surface of the cylinder head. The deck surface is a surface constituting the upper surface deck of the cylinder head.

The second through hole opens to a side surface of the cylinder head in which cam pulleys of intake and exhaust cam shafts are provided. The second through hole penetrates the upper surface deck along an axial direction of the intake and exhaust cam shafts.

The second through hole is positioned vertically below an opening in the deck surface of the first through hole.

A second aspect of the present disclosure further has the following features in first aspect.

The cylinder head is made of aluminum alloy.

The cylinder head further comprises a slope part.

The slope part leads to an opening of the second through hole in the side surface. The slope part inclines downwardly in the vertical direction as it moves away from the opening of the second through hole.

A third aspect of the present disclosure further has the following features in the first aspect.

The intake cam shaft is positioned above the exhaust cam shaft in the vertical direction.

The opening of the first through hole is formed in the deck surface located below the exhaust cam shaft in the vertical direction.

The second through hole is formed in the deck surface located below intake cam shaft in the vertical direction.

According to the first aspect, it is possible to collect the engine oil that was supplied to the intake and exhaust cam shafts in the oil pan via the first or second through hole. Here, the second through hole is formed along the axial direction of the intake and exhaust cam shafts. Therefore, when the engine oil flows through the second through hole, it is possible to cool the engine oil by an engine coolant in a water jacket. Therefore, it is possible to cool the engine oil without resorting to the cooling by the external device.

According to the second aspect, it is possible to flow the engine oil that was discharged from the opening of the second through hole along a surface of the slope part. That is, it is possible to flow the engine oil discharged from the opening of the second through hole along the side surface. Therefore, it is possible to cool the engine oil by exchanging heat with the cylinder head made of the aluminum alloy.

According to the third aspect, when the opening of the first through hole is formed in the deck surface located below the exhaust cam shaft in the vertical direction and the second through hole is formed in the deck surface located below the intake cam shaft in the vertical direction, it is possible to collect the engine oil that was supplied to the intake and exhaust cam shafts in the oil pan through the first or second through hole.

DESCRIPTION OF EMBODIMENT

Hereinafter, an engine according to an embodiment of the present disclosure will be described with reference to drawings.

1. Engine Configuration

Figure 1:
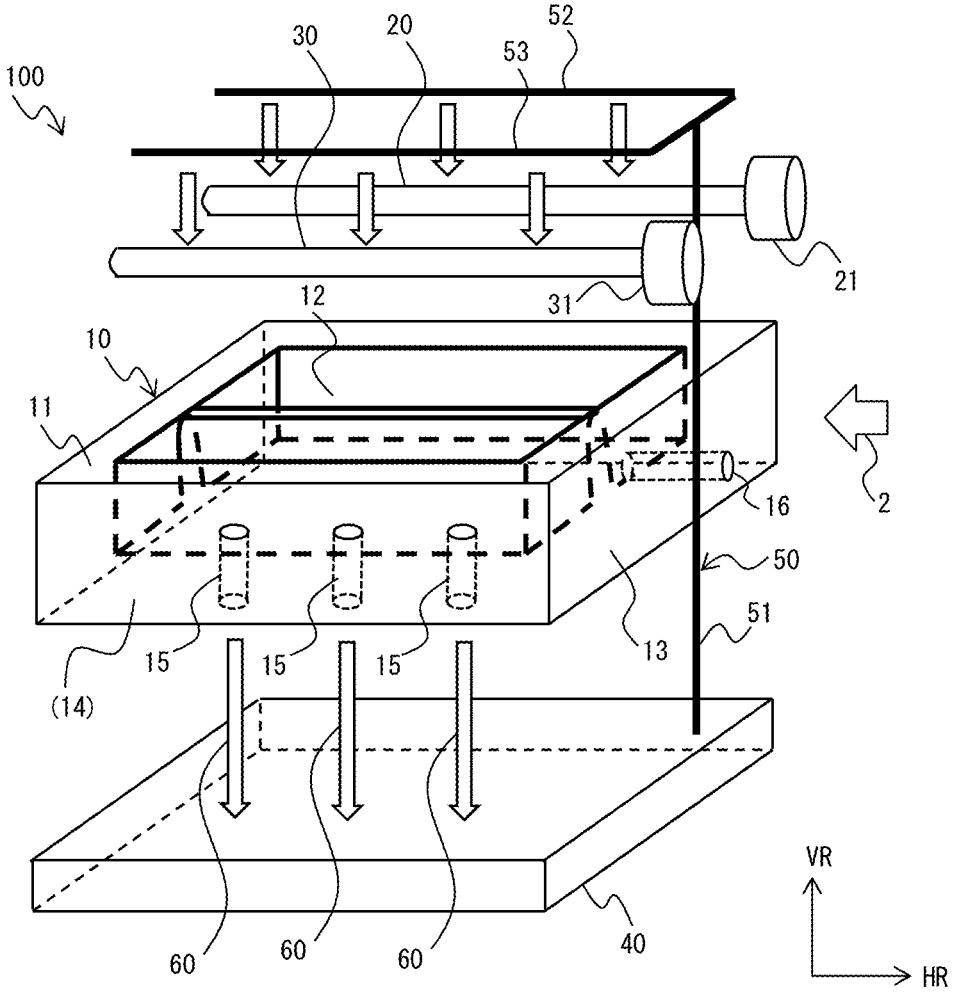
FIG. 1 is a schematic diagram showing a configuration particularly related to an engine according to an embodiment.

The engine according to the present embodiment is a reciprocating engine of Double Overhead Camshaft type. FIG. 1 is a schematic diagram showing a configuration particularly relevant to engine according to the present embodiment. Note that a VR direction shown in FIG. 1 shows an upper in the vertical direction. A HR direction indicates a direction perpendicular to the vertical direction. An engine 100 shown in FIG. 1 comprises a cylinder head 10, an intake cam shaft 20, an exhaust cam shaft 30, an oil pan 40, a delivery gallery 50, and a return path 60.

The cylinder head 10 is obtained by casting aluminum alloy. The cylinder head 10 includes an upper surface 11, a deck surface 12, a side surface 13, and a lower surface 14. The upper surface 11 supports a cam housing (not shown). The lower surface 14 is supported on a cylinder block (not shown). The engine 100 is mounted on a body frame of a vehicle while being inclined to an exhaust side. Therefore, the upper surface 11 and the lower surface 14 are inclined by predetermined angles with respect to the HR direction.

The deck surface 12 constitutes an upper surface deck of the cylinder head 10. The "upper surface deck" includes a portion for supporting various relevant components to be attached to the cylinder head 10 and a portion for ensuring an intensity of the cylinder head 10. In order to reduce weight of the cylinder head 10, volume of these parts is designed to be a minimum value. Therefore, an actual upper surface deck is composed of parts having various shapes, and therefore, the actual deck surface 12 is not flat. In the upper surface deck, three first through holes 15 are formed each of which penetrates from the deck surface 12 toward the lower surface 14. Each axis of these first through holes 15 is inclined at predetermined angles relative to the VR direction. The total number of the first through holes 15 is not limited to three.

The cylinder head 10 has four side surfaces. The side surface 13 shown in FIG. 1 is one of these side surfaces. The side surface 13 is provided with cam pulleys 21 and 31 around which a timing belt (or a timing chain) is hung. Therefore, an actual side surface 13 is covered by a belt cover. In the side surface 13, a second through hole 16 that penetrates from the side surface 13 toward the deck surface 12 is formed. The second through hole 16 is formed along the axial direction of the intake cam shaft 20 (or the exhaust cam shaft 30). Detail of the second through hole 16 will be described later.

The intake cam shaft 20 supports cams (not shown) for driving intake valves. The exhaust cam shaft 30 supports cams (not shown) for driving exhaust valves. As mentioned above, the engine 100 is inclined to the exhaust side. Therefore, in practice, the intake cam shaft 20 is positioned above the exhaust cam shaft 30 in the VR direction.

In the oil pan 40, an engine oil is stored. The engine oil in the oil pan 40 is sucked up by an oil pump (not shown) that is driven in conjunction with a rotation of a crankshaft (not shown) and then supplied to a delivery gallery 50. The delivery gallery 50 has a main gallery 51. The main gallery 51 is formed inside the engine 100. Inside the cylinder head 10, the main gallery 51 is formed in a portion close to the side surface 13.

The main gallery 51 is connected to oil shower pipes 52 and 53. The oil shower pipe 52 injects the engine oil toward the intake cam shaft 20. The oil shower pipe 53 injects the engine oil toward the exhaust cam shaft 30.

The engine oil injected toward these cam shafts flows down according to gravitational force and reaches the deck surface 12. A part of the engine oil reaching the deck surface 12 further flows down the first through hole 15 due to the gravitational force and then flows into a return path 60. The return path 60 is formed inside the engine 100. The engine oil flowing through the return path 60 is collected in the oil pan 40.

2. Configuration of Cylinder Head

A path through the deck surface 12, the first through holes 15 and the return path 60 is a basic collection route in the engine 100. The engine 100 is provided with an additional collection route via the deck surface 12, the second through hole 16 and the side surface 13. Hereinafter, the reason why this additional collection route is provided and the detail of this route will be explained by referring to FIGS. 2 to 6.

Figure 2:
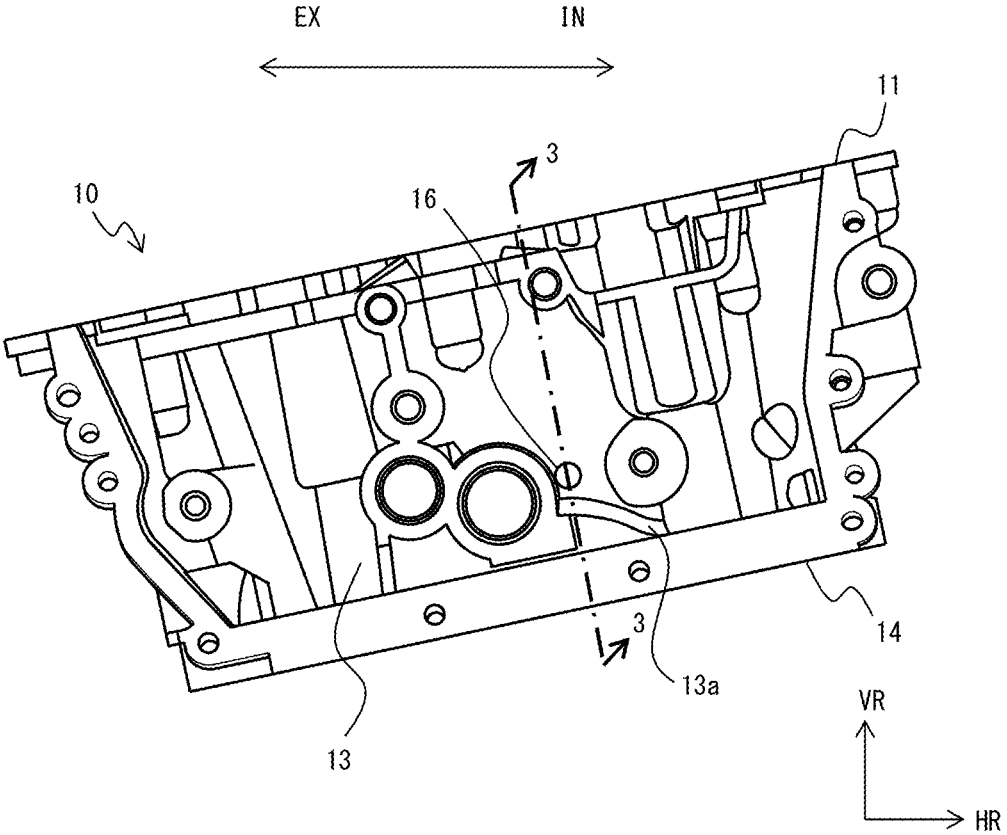
FIG. 2 is a side view of a cylinder head of the engine according to the embodiment.

First, the reason why the additional route is provided will be described. FIG. 2 is a side view of the cylinder head 10. FIG. 2 corresponds to a diagram in which the cylinder head 10 is viewed from an arrow 2 shown in FIG. 1. As shown in FIG. 2, the cylinder head 10 is inclined toward the exhaust side. The reason for this is that engine 100 is inclined to the exhaust side. The tilt angle of cylinder head 10 is equal to the predetermined angle.

Figure 3:
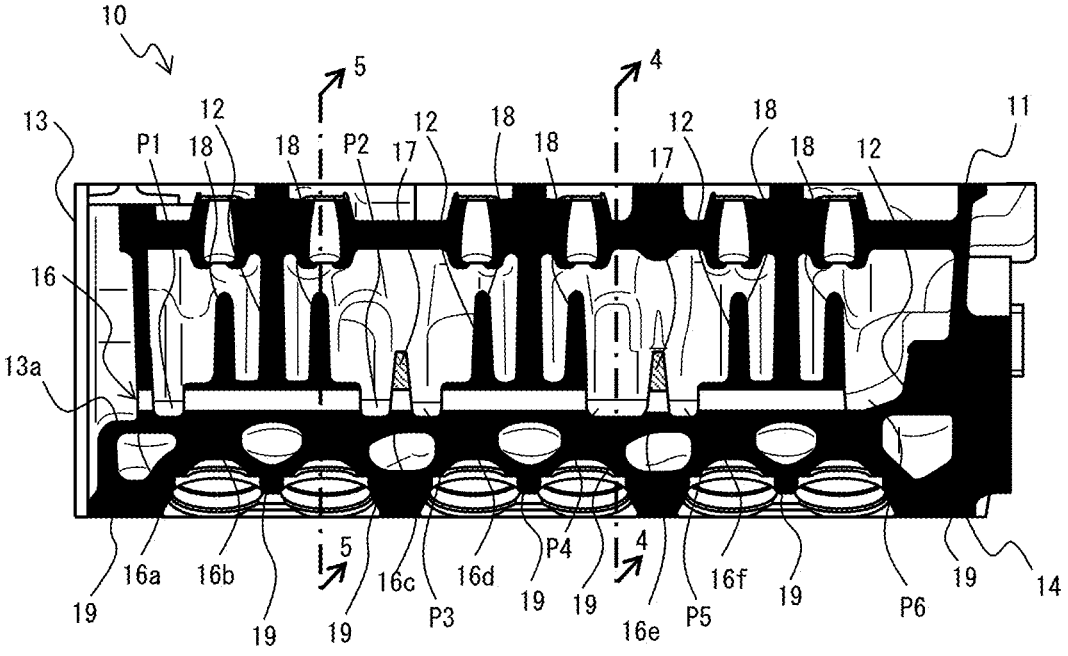
FIG. 3 is a cut plane of the cylinder head along a line 3-3 shown in FIG. 2.

FIG. 3 is a cut plane of the cylinder head 10 along a line 3-3 shown in FIG. 2. As shown in FIG. 3, the deck surface 12 has complex undulations. The deck surface 12 includes regions corresponding to surfaces of the ribs 17 and 18. The cylinder head 10 includes three cylinders, and the ribs 17 are reinforcing portions provided between two adjacent cylinders. The ribs 18 are reinforcing portions provided at a total of six intake port positions. By providing such the ribs, a part of an area of the deck surface 12 is recessed as compared with other areas.

Figure 4:
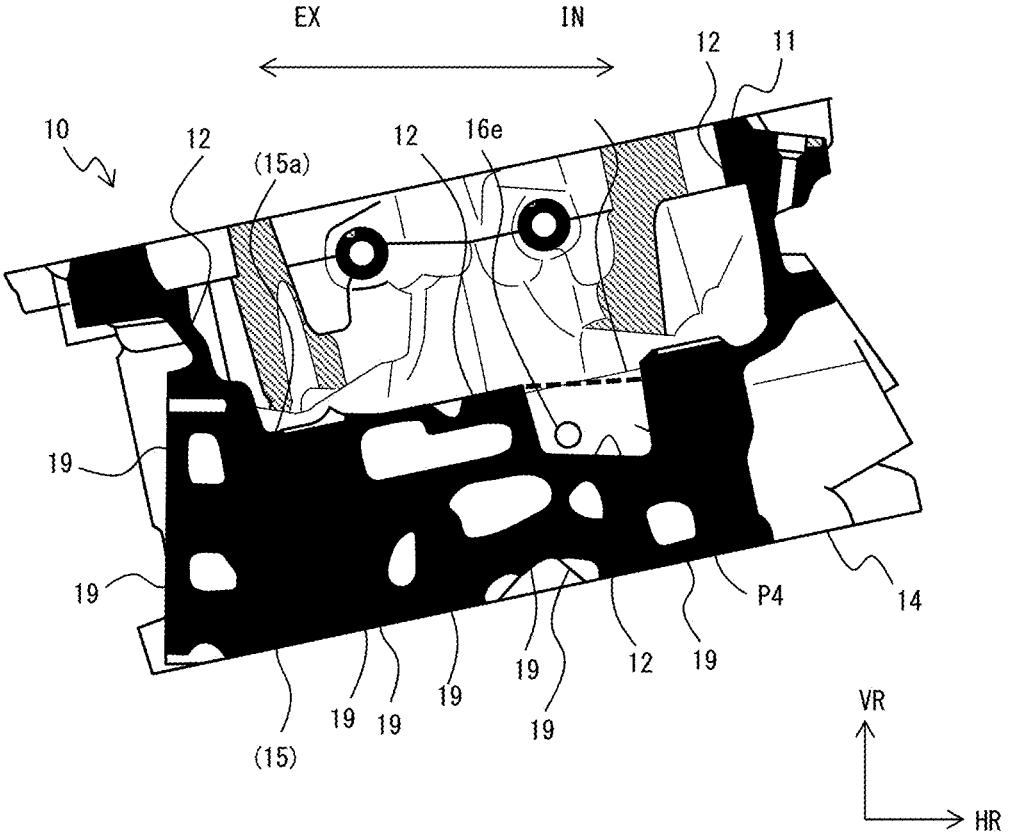
FIG. 4 is a cut plane of the cylinder head along a line 4-4 shown in FIG. 3.
Figure 5:
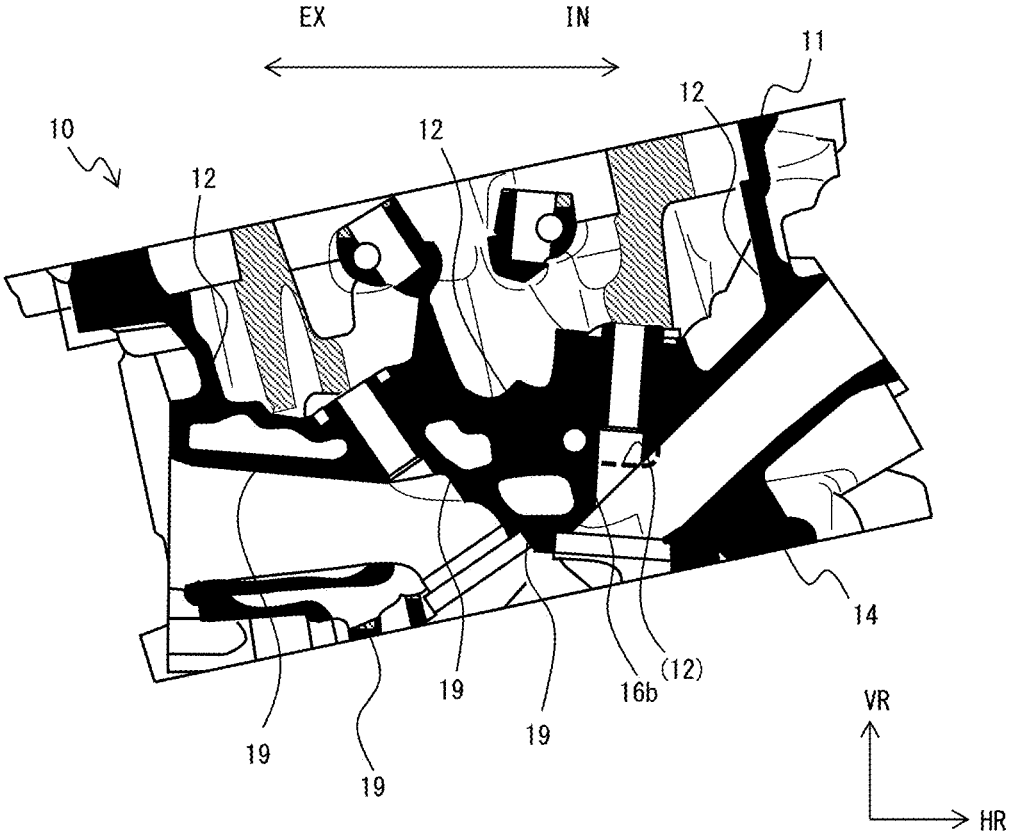
FIG. 5 is a cut plane of cylinder head along a line 5-5 shown in FIG. 3.

Spaces P1 to P6 shown in FIG. 3 corresponds to spaces surrounded by the recessed area. Details of the spaces P1 to P6 will be described with reference to FIG. 4. FIG. 4 is a cut plane of the cylinder head 10 along a line 4-4 shown in FIG. 3. FIG. 5 is a cut plane of the cylinder head 10 along the line 5-5 shown in FIG. 3. As shown in FIG. 4, a region of the deck surface 12 that forms the space P4 is located below in the VR direction relative to other regions of the deck surface 12 leading to this region.

The reason why such a positional relationship is indicated is as follows. That is, as indicated by a broken line in FIG. 4, the first through holes 15 are formed in the deck surface 12 on the exhaust side of the cylinder head 10. The reason why the first through holes 15 are formed at this position is that the cylinder head 10 is inclined to the exhaust side. Since the engine oil moves according to the gravitational force, it is expected that the engine oil is directed toward the exhaust side of the cylinder head 10 in the deck surface 12.

However, the temperature on the exhaust side of the cylinder head 10 tends to be higher than that on the intake side. Therefore, the exhaust side portion of the cylinder head 10 must be supplied with an engine coolant by stretching water jacket 19. On the other hand, since there is no need on the intake side, the intake side portion is shaved. Therefore, a region of the deck surface 12 forming the space P4 is located below openings 15*a* of the first through holes 15 in the VR direction. As a result, it is difficult for the engine oil in the space P4 to move from the intake side toward the exhaust side of the cylinder head 10.

When it is impossible to move from the intake side to the exhaust side, it is considered that the engine oil in the space P4 moves in an arrangement direction of cylinders in the cylinder head 10. However, as shown in FIG. 5, there are portions for supporting the relevant components in the arrangement direction. Therefore, the deck surface 12 corresponding to the surface of this portion is positioned above the deck surface 12 forming the space P4 in the VR direction. Therefore, it is also difficult for the engine oil in the space P4 to move in the arrangement direction. As described above, when the engine oil flows into the space P4, it cannot escape therefrom. This is also true when the engine oil flows into the spaces other than the space P4.

In view of such problems, the present embodiment provides the second through hole 16. As shown in FIG. 3, the second through hole 16 contains second through holes 16*a* to 16*f* The second through hole 16*a* connects the side surface 13 and the deck surface 12 that forms the space P1. The second through hole 16*b* connects the deck surface 12 that forms the space P1 and the deck surface 12 that forms the space P2. Similar to the second through hole 16*b*, the second through holes 16*c* to 16*f* connects the deck surfaces that form the adjacent spaces.

Figure 6:
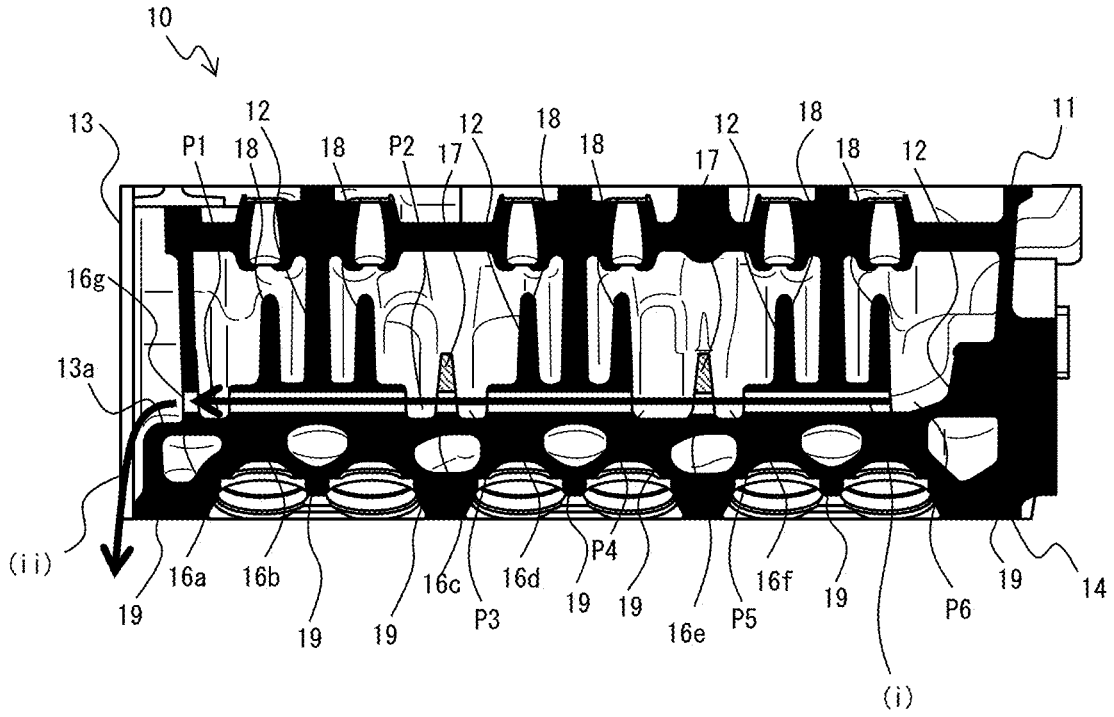
FIG. 6 is a diagram showing a flow of an engine oil in the cylinder head shown in FIG. 3.

FIG. 6 is a diagram showing a flow of the engine oil in the cylinder head 10. As shown in FIG. 6, the spaces P1 to P6 are connected by the second through holes 16*a* to 16*f*. Therefore, the engine oil can be flowed in the direction of the arrow (i) (i.e., the arrangement direction of the cylinders). Pressure in the spaces P1 to P6 is abbreviated to pressure in a space on the side surface 13 (i.e., pressure in a belt room). Therefore, the engine oil flowing toward the arrow (i) is gently discharged from an opening 16*g* of the second through hole 16 (i.e., the second through hole 16*a*) formed on the side surface 13. The engine oil discharged from the opening 16*g* is collected in the oil pan 40 via the side surface 13.

Note that the second through holes 16*a* to 16*f* are formed by performing drilling from the side surface 13 along the arrangement direction. In this case, machining is performed so as to avoid other machining holes already formed in the cylinder head 10 (e.g., machining holes for valve guides). The second through hole 16*a* to 16*f* may be formed by cast holes. In the case of casting, it is possible to form the second thorough holes 16*a* to 16*f* according to a position of the lowermost deck surface 12 that forms spaces P1 to P6 in the vertical direction.

In the present embodiment, the side surface 13 is also provided with a slope part 13*a*. As shown in FIG. 3, the slope part 13*a* is formed to lead to the opening 16*g*. The slope part 13*a* inclines while bending downward in the vertical direction as it moves away from the opening 16*g*. Therefore, as shown in FIG. 6, the engine oil discharged from the opening 16*g* flows in the direction of an arrow (ii) (i.e., a direction along the side surface 13).

Figure 7:
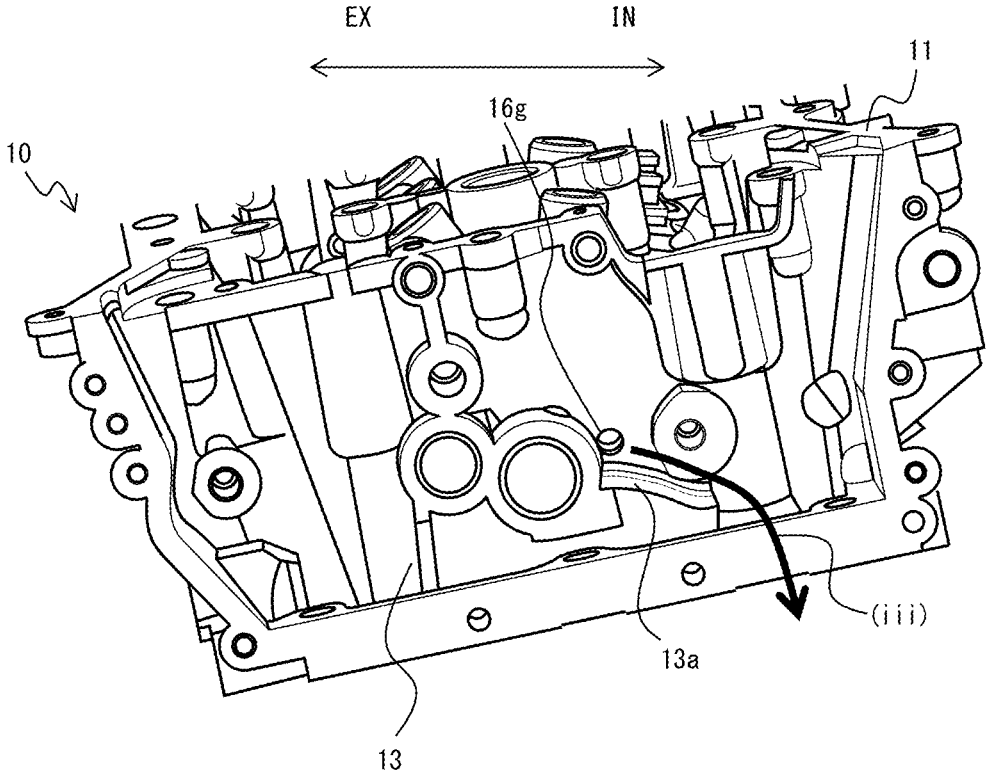
FIG. 7 is a perspective view of the cylinder head of the engine according to the embodiment.

FIG. 7 is a perspective view of the cylinder head 10. FIG. 7 is also a view in which the cylinder head 10 seen from the arrow 2 shown in FIG. 1 is slightly inclined forward. As shown in FIG. 7, the slope part 13*a* extends to the intake side from a position of the opening 16*g*. The slope part 13*a* also curves and tilts away from the opening 16*g* in an intake direction. Therefore, as shown in FIG. 7, the engine oil discharged from the opening 16*g* flows not only in the direction of the arrow (ii) shown in FIG. 6 but also in a direction of arrow (iii) (i.e., the direction along the side surface 13 and the intake direction of the cylinder head 10).

3. Effect

According to the present embodiment described above, it is possible to collect the engine oil not only by a route through the first through holes 15 but also by the additional route through the second through hole 16. In particular, according to the additional route through the second through hole 16, it is possible to cool the engine oil that flows through the second through hole 16 by the engine coolant in the water jacket 19. Therefore, it is possible to cool the engine oil without resorting to the cooling by an external device such as an oil cooler.

Further, according to the present embodiment, it is possible to flow the engine oil discharged from the opening 16*g* along the surface of the slope part 13*a*. That is, it is possible to flow the engine oil along the side surface 13. Therefore, it is possible to cool the engine oil by exchanging heat with the cylinder head 10.

4. Other Embodiments

Incidentally, in the above embodiment, the first through holes 15 are formed on the exhaust side of the deck surface 12, and the second through hole 16 are formed on the intake side of the deck surface 12. However, the cylinder head may be inclined toward the intake side. In this instance, a positional relationship of the first through holes 15 and the second through hole 16 is reversed. However, the positional relationship between the second thorough hole 16 and the openings 15*a* must be the same as that in the embodiment described above. That is, the position of the second through hole 16 needs to be vertically lower than the openings 15*a*.

The cylinder head 10 may not be inclined to either the exhaust side or the intake side. In this instance, the positional relationship between the first through holes 15 and the second through hole 16 is arbitrarily set. However, even in this instance, the positional relationship between the second through hole 16 and the openings 15*a* needs to be the same as that in the embodiment described above.

What is claimed is:

1. An internal combustion engine, comprising: a cylinder head that includes a water jacket; and intake and exhaust cam shafts that are disposed above the cylinder head in a vertical direction and are supplied with an engine oil in an oil pan, wherein the cylinder head further includes: a first drain hole that penetrates an upper surface deck from a deck surface towards a lower surface of the cylinder head, wherein the deck surface is a surface constituting the upper surface deck of the cylinder head; and a second drain hole that opens to a side surface of the cylinder head in which cam pulleys of intake and exhaust cam shafts are provided and penetrates the upper surface deck along an axial direction of the intake and exhaust cam shafts, wherein the second drain hole is positioned vertically below an opening in the deck surface of the first drain hole; the cylinder head further includes a slope part; and the slope part leads to an opening of the second drain hole in the side surface and inclines downwardly in the vertical direction as it moves away from the opening of the second drain hole.

2. The internal combustion engine according to claim 1, wherein: the cylinder head is made of aluminum alloy.

3. The internal combustion engine according to claim 1, wherein the second drain hole horizontally penetrates the upper surface deck along the axial direction of the intake and exhaust cam shafts.

4. The internal combustion engine according to claim 1, wherein the second drain hole horizontally penetrates the upper surface deck along the axial direction of the intake and exhaust cam shafts, and the second drain hole is formed in the deck surface located below the intake cam shaft in the vertical direction.

5. The internal combustion engine according to claim 1, wherein the desk surface has a recessed area, and the second drain hole is connected to the recessed area to discharge the engine oil collected in the recessed area to the opening of the second drain hole in the side surface.

6. The internal combustion engine according to claim 1, wherein the desk surface has a plurality of recessed areas, and the second drain hole is connected to the plurality of recessed areas to discharge the engine oil collected in the plurality of recessed areas to the opening of the second drain hole in the side surface.

7. The internal combustion engine according to claim 1, wherein the opening of the second drain hole in the side surface is located below the cam pulleys of the intake and exhaust cam shafts in the vertical direction.

8. An internal combustion engine, comprising: a cylinder head that includes a water jacket; and intake and exhaust cam shafts that are disposed above the cylinder head in a vertical direction and are supplied with an engine oil in an oil pan, wherein the cylinder head further includes: a first drain hole that penetrates an upper surface deck from a deck surface towards a lower surface of the cylinder head, wherein the deck surface is a surface constituting the upper surface deck of the cylinder head; and a second drain hole that opens to a side surface of the cylinder head in which cam pulleys of intake and exhaust cam shafts are provided and penetrates the upper surface deck along an axial direction of the intake and exhaust cam shafts; wherein the second drain hole is positioned vertically below an opening in the deck surface of the first drain hole; the intake cam shaft is positioned above the exhaust cam shaft in the vertical direction; the opening of the first drain hole is formed in an exhaust side of the deck surface located below the exhaust cam shaft in the vertical direction; and the second drain hole is formed in an intake side of the deck surface located below the intake cam shaft in the vertical direction.

9. An internal combustion engine, comprising: a cylinder head that includes a water jacket; and intake and exhaust cam shafts that are disposed above the cylinder head in a vertical direction and are supplied with an engine oil in an oil pan, wherein the cylinder head further includes: a first drain hole that penetrates an upper surface deck from a deck surface towards a lower surface of the cylinder head, wherein the deck surface is a surface constituting the upper surface deck of the cylinder head; and a second drain hole that opens to a side surface of the cylinder head in which cam pulleys of intake and exhaust cam shafts are provided and penetrates the upper surface deck along an axial direction of the intake and exhaust cam shafts; wherein the second drain hole is positioned vertically below an opening in the deck surface of the first drain hole; the side surface further includes a slope part which leads to an opening of the second drain hole in the side surface to receive the engine oil discharged from the second drain hole and guide the discharged engine oil downwardly in the vertical direction; one of the intake cam shaft and the exhaust cam shaft is positioned above the other in the vertical direction, and the slope part inclines downwardly in the vertical direction as the slope part extends away from the opening of the second drain hole and toward said one of the intake cam shaft and the exhaust cam shaft.

* * * * *